US011041679B2

(12) United States Patent
Ramanujam et al.

(10) Patent No.: US 11,041,679 B2
(45) Date of Patent: Jun. 22, 2021

(54) ENERGY RECOVERY WHEEL ASSEMBLY FOR AN HVAC SYSTEM

(71) Applicant: Johnson Controls Technology Company, Auburn Hills, MI (US)

(72) Inventors: Sriram Ramanujam, Pune (IN); Shashank B. Kadam, Pune (IN); Karan Garg, Pune (IN); Rammohan Sethuraj, Tuticorin (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 227 days.

(21) Appl. No.: 16/259,904

(22) Filed: Jan. 28, 2019

(65) Prior Publication Data

US 2020/0232719 A1 Jul. 23, 2020

Related U.S. Application Data

(60) Provisional application No. 62/794,933, filed on Jan. 21, 2019.

(51) Int. Cl.
*F28D 19/04* (2006.01)

(52) U.S. Cl.
CPC ..... *F28D 19/044* (2013.01); *F24F 2203/104* (2013.01); *F24F 2203/108* (2013.01); *F24F 2203/1012* (2013.01)

(58) Field of Classification Search
CPC ..... F24F 2203/1032; F24F 2203/1004; F24F 2203/101; F24F 2203/1012;
(Continued)

(56) References Cited

U.S. PATENT DOCUMENTS 2,464,766 A * 3/1949 Pennington ..... F24F 6/06 62/95
3,789,916 A * 2/1974 Lindahl ..... F28D 19/044 96/125
(Continued)

FOREIGN PATENT DOCUMENTS

DE 102014208817 A1 * 11/2015 ..... F24F 12/00
DE 202016106933 U1 * 2/2017 ..... F28D 19/048
(Continued)

OTHER PUBLICATIONS

DE 102014208817 A1 English Translation (Year: 2015).*
DE 202016106933 U1 English Translation (Year: 2017).*
JP S54131339 A English Translation (Year: 1979).*

*Primary Examiner* — Len Tran
*Assistant Examiner* — Jenna M Hopkins
(74) *Attorney, Agent, or Firm* — Fletcher Yoder, P.C.

(57) ABSTRACT

An energy recovery wheel includes a frame positioned within a passage of a heating, ventilation, and/or air conditioning (HVAC) system. The frame is configured to rotate about an axis of the passage relative to the HVAC system and includes an opening that is configured to transmit an air flow. The energy recovery wheel also includes a heat transfer element coupled to the frame and positioned within the opening, where the heat transfer element is permeable and configured to transition between a closed orientation to occlude the opening and direct the air flow across the heat transfer element and an open orientation to substantially unblock the opening and mitigate interaction between the air flow and the heat transfer element.

25 Claims, 11 Drawing Sheets

(58) Field of Classification Search
CPC ..... F24F 2203/1016; F24F 2203/1036; F24F 2203/1048; F24F 2203/1068; F24F 2203/108; F24F 2203/1084; F24F 2203/1096; F28D 19/00; F28D 19/04; F28D 19/041; F28D 19/042; F28D 19/044; F28D 19/048
See application file for complete search history.

(56) References Cited

U.S. PATENT DOCUMENTS 4,234,038 A * 11/1980 Dravnieks ..... F24F 3/1423 165/10
4,594,860 A * 6/1986 Goellner ..... F24F 3/1423 165/10
5,169,414 A * 12/1992 Panzica ..... B01D 53/0431 95/113
5,183,098 A * 2/1993 Chagnot ..... F24F 3/1423 165/54
5,408,932 A 4/1995 Hesse et al.
5,649,428 A * 7/1997 Calton ..... F24F 3/1411 62/94
6,004,384 A * 12/1999 Caudle ..... B01D 53/261 55/502
7,082,987 B2 8/2006 Hamilton
7,217,313 B2 * 5/2007 Motono ..... B01D 53/06 95/113
7,753,766 B2 * 7/2010 Master ..... H05K 7/20745 454/184
7,886,986 B2 * 2/2011 Fischer, Jr. ..... F24F 3/1423 236/49.3
8,845,404 B2 * 9/2014 Bash ..... F24F 13/105 454/187
8,876,957 B2 11/2014 Fujioka
9,388,825 B1 * 7/2016 Behbehani ..... F24F 7/007
9,404,689 B2 * 8/2016 Hakbijl ..... F24F 3/14
9,907,214 B2 * 2/2018 Dagley ..... H05K 7/20836
2005/0252229 A1 * 11/2005 Moratalla ..... B01D 53/26 62/271
2005/0262862 A1 * 12/2005 Moffitt ..... F24F 3/1423 62/271
2017/0108287 A1 * 4/2017 Nilsson ..... F28D 19/044
2020/0232719 A1 * 7/2020 Ramanujam ..... F28D 19/044

FOREIGN PATENT DOCUMENTS

EP 3336472 A1 6/2018
JP 54131339 A * 10/1979
WO 2010144032 A1 12/2010
WO 2012011865 A2 1/2012
WO 2018073617 A1 4/2018

* cited by examiner

ENERGY RECOVERY WHEEL ASSEMBLY FOR AN HVAC SYSTEM

CROSS-REFERENCE TO RELATED APPLICATIONS

This application claims priority from and the benefit of U.S. Provisional Application Ser. No. 62/794,933, entitled "ENERGY RECOVERY WHEEL ASSEMBLY FOR AN HVAC SYSTEM," filed Jan. 21, 2019, which is herein incorporated by reference in its entirety for all purposes.

BACKGROUND

This disclosure relates generally to heating, ventilation, and/or air conditioning (HVAC) systems. Specifically, the present disclosure relates to an energy recovery wheel for HVAC units.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A heating, ventilation, and/or air conditioning (HVAC) system may be used to thermally regulate an environment, such as a building, home, or other structure. The HVAC system generally includes a vapor compression system that includes heat exchangers, such as a condenser and an evaporator, which transfer thermal energy between the HVAC system and the environment. In many cases, the HVAC system may direct a continuous flow of fresh outdoor air into a building to provide ventilation and improved air quality within the building, while stale return air of the building is discharged into an ambient environment, such as the atmosphere. The HVAC system may include an energy recovery wheel that is configured to recover energy from the return air prior to discharging the return air into the atmosphere, thus improving an efficiency of the HVAC system.

For example, the energy recovery wheel may be situated within and configured to rotate relative to a flow path of the return air and a flow path of the outdoor air. The energy recovery wheel typically includes heat transfer elements that are configured to transition between the return air flow path and the outdoor air flow path of the HVAC system as the energy recovery wheel rotates. The heat transfer elements are generally porous and enable air flowing therethrough to absorb thermal energy from or release thermal energy to the heat transfer elements. In cases when the HVAC system is operating in a cooling mode, the return air discharging from the building may be cooler than the outdoor air entering the HVAC system. Accordingly, when the energy recovery wheel rotates, the heat transfer elements may cyclically absorb thermal energy from the warmer outdoor air and subsequently release the absorbed thermal energy to the cooler return air passing through the return air flow path. As a result, the energy recovery wheel may pre-cool the outdoor air before the outdoor air flows through the rest of the HVAC system. In some cases, it is desirable to temporarily suspend operation of the energy recovery wheel, such as when a temperature of the outdoor air entering the HVAC system is substantially equal to a temperature of the return air discharging from the building. Unfortunately, the deactivated energy recovery wheel may hinder air flow along the outdoor air flow path and the return air flow path and may thus reduce an overall operational efficiency of the HVAC system.

SUMMARY

The present disclosure relates to an energy recovery wheel for a heating, ventilation, and/or air conditioning (HVAC) system. The energy recovery wheel includes a frame that is positioned within a passage of the HVAC system. The frame is configured to rotate about an axis of the passage relative to the HVAC system and includes an opening that is configured to transmit an air flow. The energy recovery wheel also includes a heat transfer element coupled to the frame and positioned within the opening, where the heat transfer element is permeable and configured to transition between a closed orientation to occlude the opening and direct the air flow across the heat transfer element and an open orientation to substantially unblock the opening and mitigate interaction between the air flow and the heat transfer element.

The present disclosure also relates to an energy recovery wheel for a heating, ventilation, and/or air conditioning (HVAC) system, where the energy recovery wheel includes an inner frame disposed within an air flow path of the HVAC system. The inner frame is positioned within the air flow path and is rotatable with respect to the HVAC system, and a plurality of dividers extend from the inner frame. The energy recovery wheel further includes a plurality of matrix segments configured to transfer heat and moisture between air flows, where each matrix segment of the plurality of matrix segments is mounted between a pair of dividers of the plurality of dividers, such that each matrix segment is configured to pivot relative to the inner frame.

The present disclosure also relates to an energy recovery wheel for a heating, ventilation, and/or air conditioning (HVAC) system, where the energy recovery wheel includes a frame disposed within a passage of the HVAC system, and the frame is rotatable about an axis of the passage relative to the HVAC system. The frame includes a central hub, an outer ring disposed about the central hub, and a plurality of spokes extending between the central hub and the outer ring to form an opening therebetween. The energy recovery wheel further includes a matrix segment pivotably coupled to the frame and mounted within the opening, where the matrix segment is permeable and configured rotate relative to the frame between a closed configuration to occlude the opening and an open orientation to substantially unblock the opening.

BRIEF DESCRIPTION OF THE DRAWINGS

Various aspects of this disclosure may be better understood upon reading the following detailed description and upon reference to the drawings in which.

DETAILED DESCRIPTION

Figure 1:
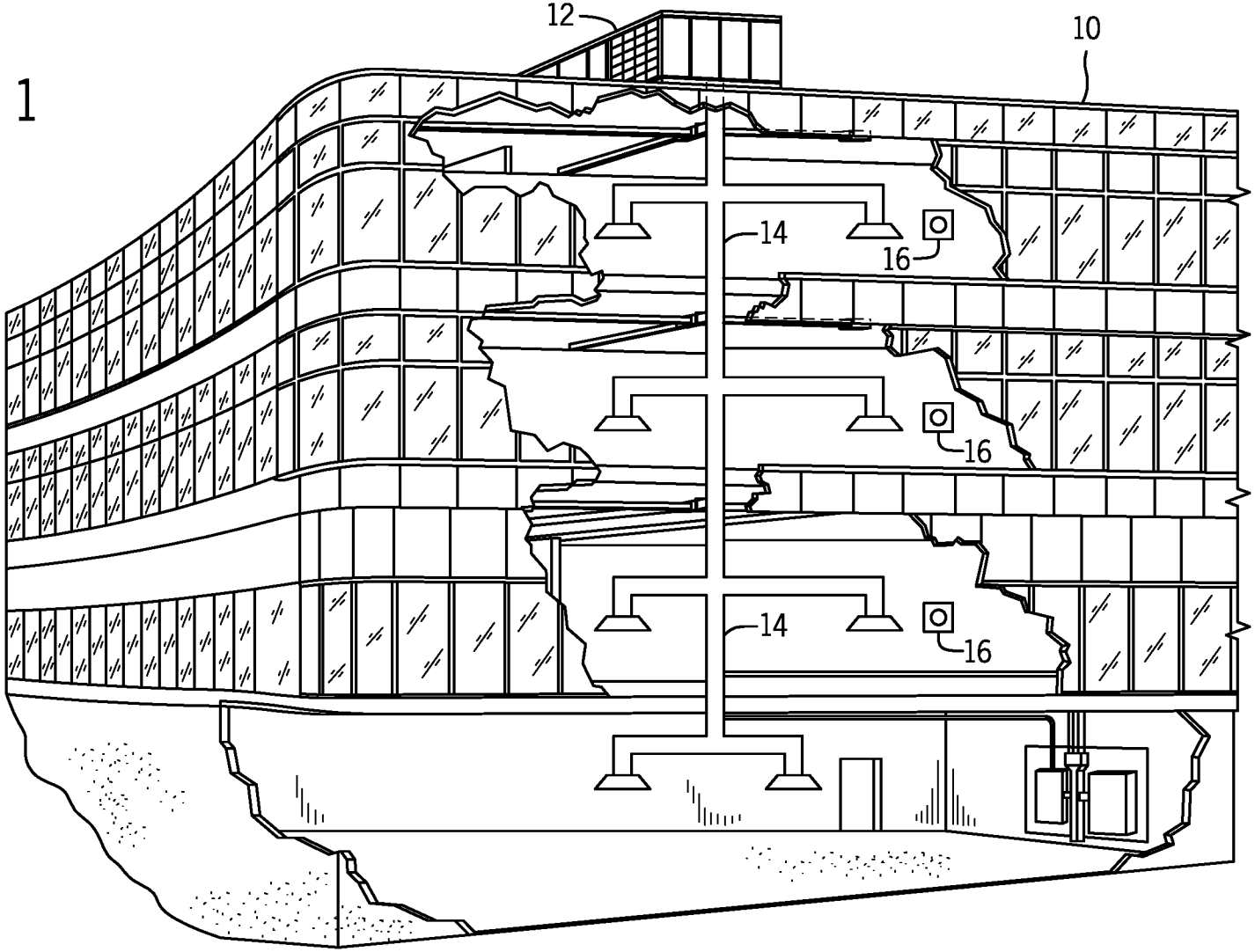
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As briefly discussed above, a heating, ventilation, and/or air conditioning (HVAC) system may be used to regulate certain climate parameters within a space of a building, home, or other suitable structure. In particular, the HVAC system may be used to exhaust stale return air from a building while simultaneously directing fresh and conditioned outdoor air into the building. Accordingly, a continuous supply of fresh, conditioned air may be circulated through an interior of the building to improve or maintain an air quality within the building. In some cases, the HVAC system may direct the return air discharging from the building across an energy recovery wheel, which may be configured to recover thermal energy from the return air before the return air is released into an ambient environment, such as the atmosphere.

For example, in some embodiments, the HVAC system may include an enclosure having a partition that extends along an interior of the enclosure to divide the enclosure into an outdoor air flow path and a return air flow path. Respective fans or blowers may be used to direct the fresh outdoor air along the outdoor air flow path and direct the stale return air along the return air flow path. The partition may include an opening formed therein, which enables the energy recovery wheel to extend through the partition and span across the outdoor air flow path and the return air flow path. Accordingly, the outdoor air and the return air may flow across respective portions of the energy recovery wheel. The energy recovery wheel may include a plurality of heat transfer elements that are configured absorb and/or release thermal energy and/or moisture from the outdoor air and return air flows. The energy recovery wheel may be configured to rotate relative to the enclosure, such that the heat transfer elements may cyclically rotate into and out of the outdoor air flow path and the return air flow path. In this manner, the energy recovery wheel may transfer thermal energy and/or moisture from the outdoor air flowing along the outdoor air flow path to the return air flowing along the return air flow path, and vice versa.

As an example, in embodiments where the HVAC system is operating in a cooling mode, a temperature of the outdoor air entering the enclosure may be warmer than a temperature of the return air discharging from the building. The relatively cool return air may absorb thermal energy from the heat transfer elements of the energy recovery wheel positioned within the return air flow path, thereby decreasing a temperature of these heat transfer elements. Due to the rotational motion of the energy recovery wheel within the HVAC system, the cooled heat transfer elements may gradually rotate out of the return air flow path and into the outdoor air flow path. Accordingly, upon transitioning into the outdoor air flow path, the cooled heat transfer elements may absorb thermal energy from the warmer outdoor air flowing thereacross. As a result, the energy recovery wheel may be used to pre-cool or pre-condition the outdoor air before the outdoor air reaches other heat exchange components of the HVAC system, such as an evaporator assembly.

In certain cases, the outdoor air may also include a relatively high humidity value, as compared to a humidity value of the return air. In such cases, the energy recovery wheel may be used to dehumidify the outdoor air entering the HVAC system by transferring moisture from the outdoor air to the return air, in accordance with the techniques discussed above. That is, the heat transfer elements of the energy recovery wheel may be configured to absorb and release moisture, in addition to the absorption and release of thermal energy.

In some cases, it may be desirable to temporarily deactivate the energy recovery wheel, such as when a temperature value of the outdoor air entering the HVAC system is substantially equal to a temperature value of the return air discharging from the building. Indeed, in such cases, the energy recovery wheel may be ineffective to transfer thermal energy between the outdoor air flow and the return air flow of the HVAC system. Unfortunately, the inactive energy recovery wheel may restrict air flow along the outdoor air flow path and the return air flow path, which may increase a load on the fans or blowers configured to direct the outdoor air and the return air along the outdoor air flow path and the return air flow path, respectively. As a result, the inactive energy recovery wheel may increase a power consumption of these fans, and thus, reduce an overall operational efficiency of the HVAC system.

It is now recognized that reducing fluid restrictions generated by the inactive energy recovery wheel along the outdoor air flow path and the return air flow path of the HVAC system may decrease a load on the fan(s) or blower (s) that are configured to direct air flows along the outdoor air flow path and return air flow path. Accordingly, embodiments of the present disclosure are directed toward an energy recovery wheel that is transitionable between an operational configuration, in which substantially all air flowing along the outdoor air flow path and the return air flow path is directed across heat transfer elements of the energy recovery wheel, and a non-operational configuration, in which substantially all air flowing along the outdoor air flow path and return air flow path may bypass the heat transfer elements of the energy recovery wheel. By enabling air to bypass the heat transfer elements during non-operational periods of the energy recovery wheel, the fluid restrictions previously created by the inactive energy recovery wheel may be reduced or eliminated during non-operational periods of the energy recovery wheel. In this manner, a load on the fans or blowers associated with the outdoor and return air flow paths may be reduced, which may enhance an overall efficiency of the HVAC system.

For example, the energy recovery wheel may include a frame that is configured to rotate relative to an enclosure of the HVAC system. The frame may include a plurality of openings formed therein, which are each configured to receive a corresponding heat transfer element of the energy recovery wheel. Each of the heat transfer elements may be rotatably mounted to the frame via one or more pins, which enable the heat transfer elements to rotate relative to the frame. In particular, the heat transfer elements may be transitionable between a closed configuration, where the heat transfer elements occlude the openings within the frame, and an open configuration, where the heat transfer elements substantially unblock the openings of the frame. Accordingly, when the heat transfer elements transition to the closed configuration, the fans of the HVAC system may force substantially all air flowing along the outdoor air flow path and the return air flow path across the heat transfer elements of the energy recovery wheel. Conversely, when the heat transfer elements are positioned in the open configuration, air flowing along the outdoor air flow path and the return air flow path may bypass the heat transfer elements and may flow directly through the openings within the frame. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
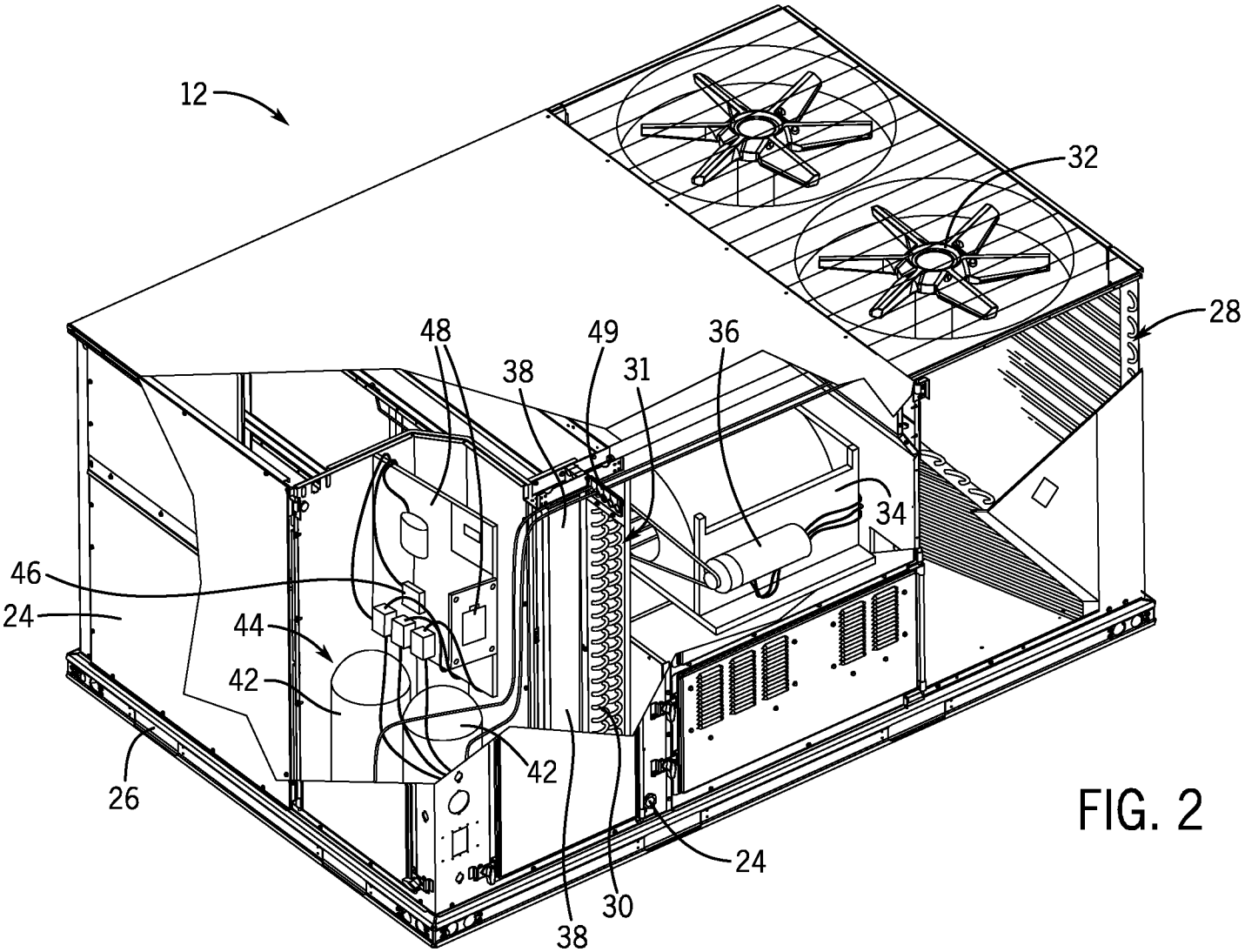
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
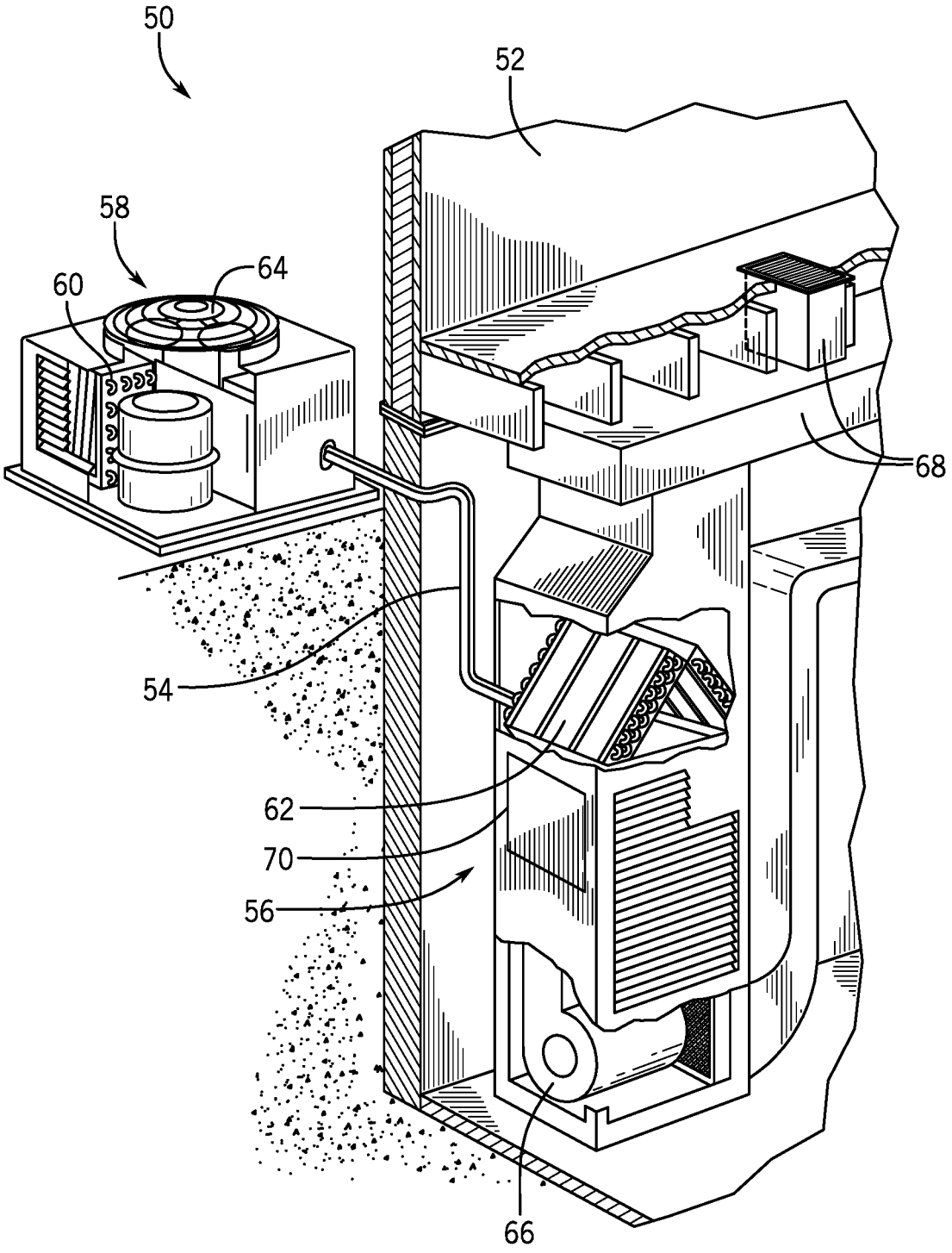
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
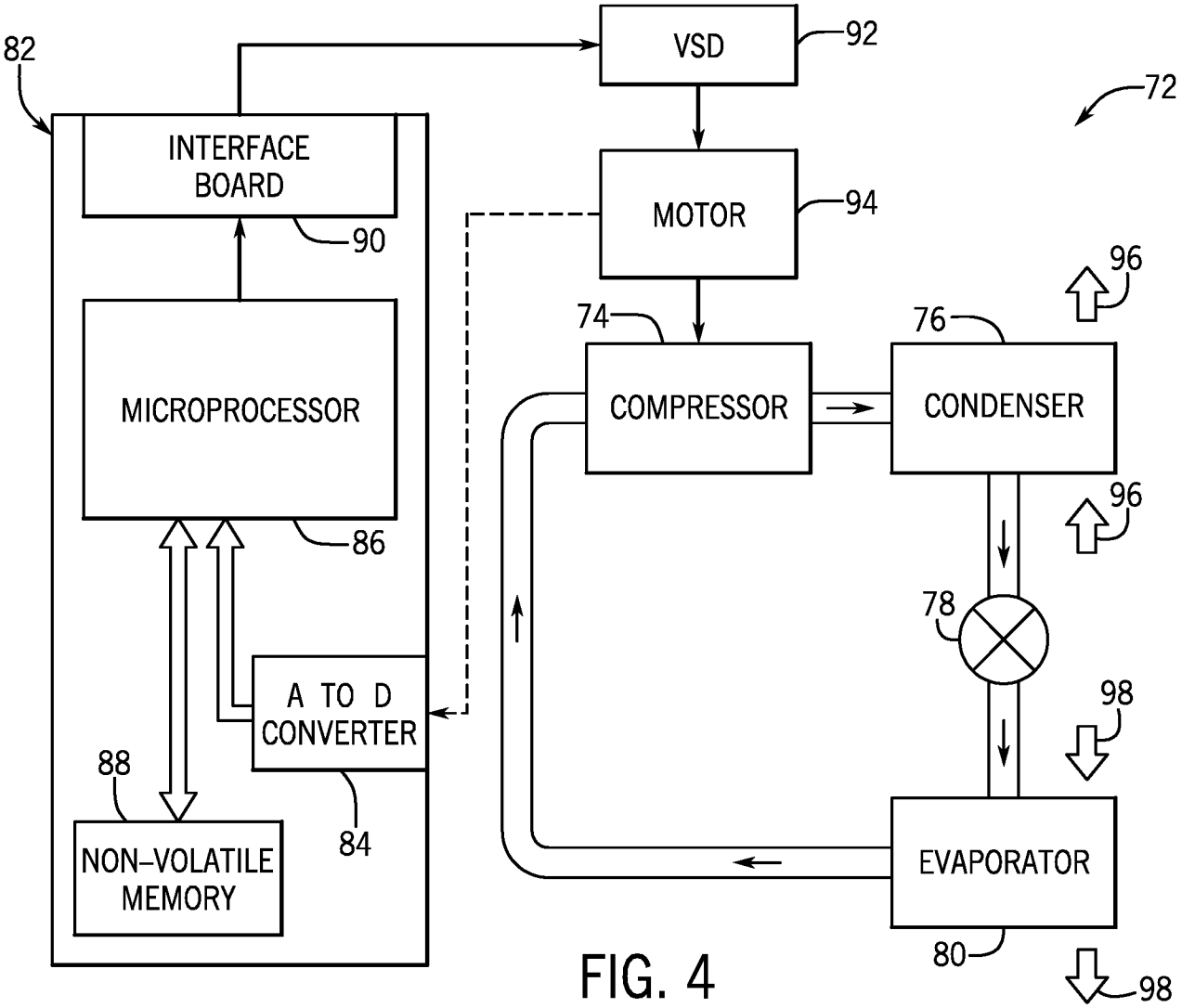
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, certain HVAC systems may include an energy recovery wheel that is configured to transfer thermal energy and/or moisture between two air flows, such as a flow of fresh outdoor air entering the HVAC system and a flow of stale return air discharging from the HVAC system. The energy recovery wheel may be disposed upstream of certain heat exchange components of the HVAC system, such as an evaporator or a furnace, and may be used to pre-condition the outdoor air before the outdoor air flows across these components. Accordingly, the energy recovery wheel may improve an operational efficiently of the HVAC system by recovering energy from return air that is typically exhausted from a cooling load, such as a building or other structure, directly into an ambient environment.

In certain cases, operation of the energy recovery wheel may be temporarily deactivated to suspend the transfer of thermal energy and/or moisture between the outdoor air and the return air flows. In conventional HVAC systems, the outdoor air flow and the return air flow are typically forced across heat transfer elements of the energy recovery wheel even when the energy recovery wheel is inactivate. Unfortunately, forcing the outdoor air and the return air across the inactive energy recovery wheel may increase a load on fan(s) or blower(s) configured to direct the outdoor air and return air through the HVAC system. As a result, the inactive energy recovery wheel may reduce an overall operational efficiency of the HVAC system. Therefore, embodiments of the present disclosure are directed toward an energy recovery wheel assembly having an energy recovery wheel that is transitionable between an operational configuration, where the outdoor air and return air flows are directed across heat transfer elements of the energy recovery wheel, and a non-operational configuration, where the outdoor air and the return air flows may bypass the heat transfer elements of the energy recovery wheel. In this manner, the energy recovery wheel assembly may allow substantially unrestricted air flow across the energy recovery wheel during non-operational periods of the energy recovery wheel.

Figure 5:
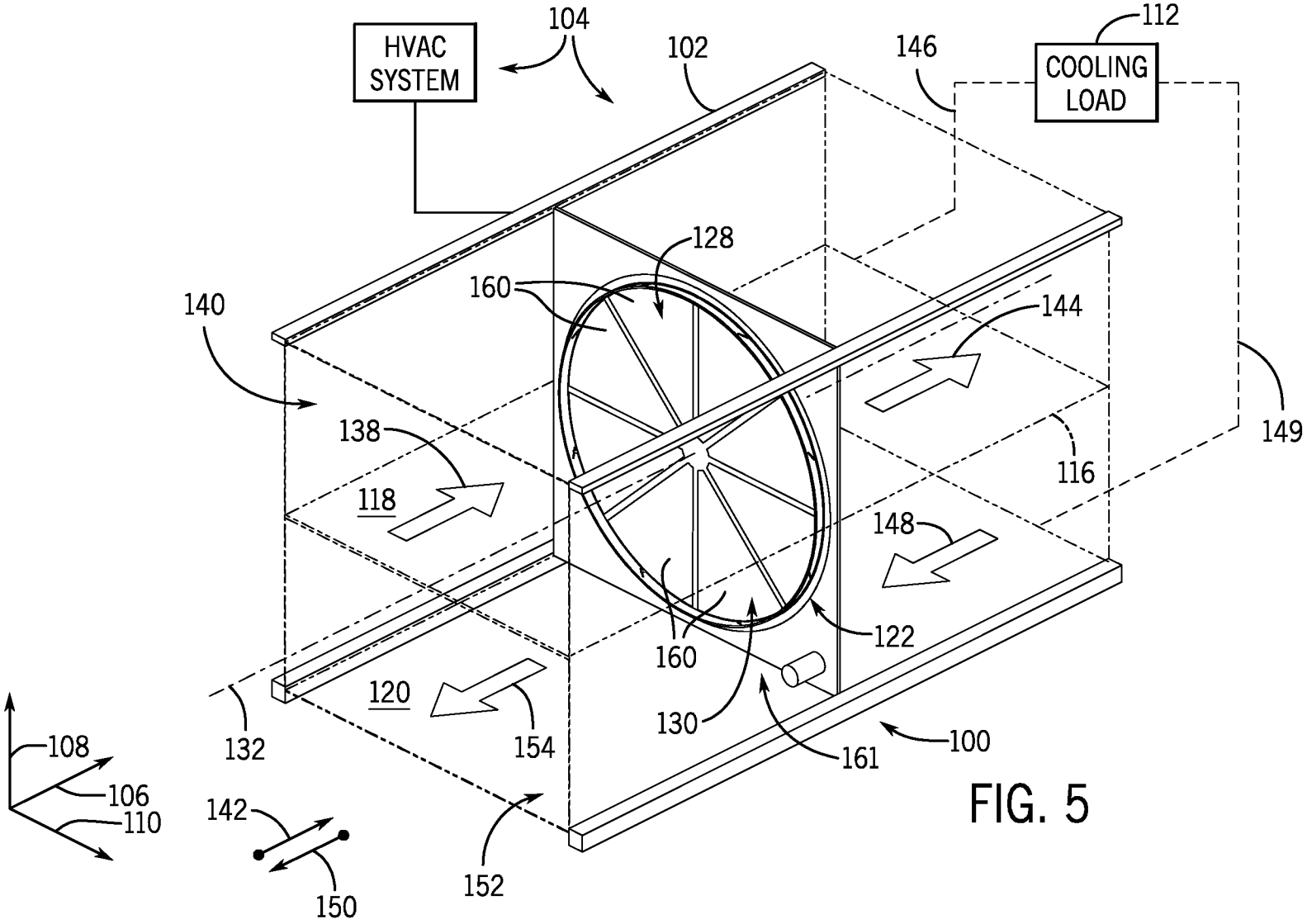
FIG. 5 is a perspective view of an embodiment of an HVAC enclosure having an energy recovery wheel assembly, in accordance with an aspect of the present disclosure.

With the foregoing in mind, FIG. 5 is a perspective view of an embodiment of an energy recovery wheel (ERW) assembly 100 that is positioned within an enclosure 102 of a heating, ventilating, and/or air conditioning (HVAC) system 104. It should be noted that the HVAC system 104 may include embodiments or components of the HVAC unit 12 shown in FIG. 2, embodiments or components of the residential heating and cooling system 50 shown in FIG. 3, a rooftop unit (RTU), or any other suitable HVAC system. To facilitate discussion, the ERW assembly 100 and its respective components will be described with reference to a longitudinal axis 106, a vertical axis 108, and a lateral axis 110.

As discussed in detail below, the HVAC system 104 may be configured to circulate a flow of conditioned air through a cooling load 112, such as a conditioned space within a building, residential home, or any other suitable structure. The HVAC system 104 may include a vapor compression system, such as the vapor compression system 72, which enables the HVAC system 104 to regulate one or more climate parameters within the cooling load 112. In particular, the HVAC system 104 may be configured to maintain a desired air quality, air humidity, and/or air temperature within the cooling load 112.

As shown in the illustrated embodiment, the enclosure 102 may include a partition 116 that divides an interior of the enclosure 102 into an outdoor air flow path 118 and a return air flow path 120. The ERW assembly 100 may extend through an opening of the partition 116 to enable an energy recovery wheel 122 of the ERW assembly 100 to span across at least a portion of the outdoor air flow path 118 and the return air flow path 120. As discussed in detail herein, this configuration may enable the energy recovery wheel 122 to transfer thermal energy and/or moisture between air flows that may respectively traverse the outdoor air flow path 118 and the return air flow path 120. As used herein, the "energy recovery wheel 122" may also refer to the entire ERW assembly 100 in subsequent discussion.

For clarity, it should be appreciated that a portion of the energy recovery wheel 122 that is disposed within the outdoor air flow path 118 will be referred to herein as a first portion 128 of the energy recovery wheel 122, while a portion of the energy recovery wheel 122 that is disposed within the return air flow path 120 will be referred to herein as a second portion 130 of the energy recovery wheel 122. It is important to note that, because the energy recovery wheel 122 may rotate during operation of the HVAC system 104, a particular section or segment of the energy recovery wheel 122 may continuously rotate into and out of the outdoor air flow path 118 and the return air flow path 120. Specifically, the energy recovery wheel 122 may rotate about a central axis 132 of the energy recovery wheel 122, which may extend generally parallel to the longitudinal axis 106. Accordingly, as used herein, the first portion 128 of the energy recovery wheel 122 refers to the portion of the energy recovery wheel 122 that is disposed within the outdoor air flow path 118 at a particular instance in time, while the second portion 130 of the energy recovery wheel 122 is refers to the portion of the energy recovery wheel 122 that is disposed within the return air flow path 120 at that same instance in time. In other words, particular sections of the energy recovery wheel 122 that correspond to the first portion 128 and the second portion 130 may be transient as the energy recovery wheel 122 rotates relative to the outdoor air flow path 118 and the return air flow path 120.

The HVAC system 104 may include one or more fans or blowers that are configured to draw a flow of outdoor air 138 into the outdoor air flow path 118 via an outdoor air inlet 140 of the enclosure 102. The fans may direct the outdoor air 138 along the outdoor air flow path 118 and across the first portion 128 of the energy recovery wheel 122 in a first direction 142 that is generally parallel to the longitudinal axis 106. As discussed below, the first portion 128 of the energy recovery wheel 122 may transfer thermal energy and/or moisture to the outdoor air 138, or may absorb thermal energy and/or moisture from the outdoor air 138, such that the outdoor air 138 discharges from the first portion 128 as supply air 144. Thereafter, the supply air 144 may flow across one or more heat exchange components (not shown) of the HVAC system 104 to further condition the supply air 144. Then, the supply air 144 may flow toward the cooling load 112 via an inlet duct, represented by dashed lines 146, of the HVAC system 104, which fluidly couples the outdoor air flow path 118 to the cooling load 112.

The return air flow path 120 may receive a flow of return air 148 from the cooling load 112 via a return air duct, represented by dashed lines 149, of the HVAC system 104, which fluidly couples the return air flow path 120 to the cooling load 112. In some embodiments, an exhaust fan or exhaust blower of the HVAC system 104 may facilitate drawing the return air 148 across the second portion 130 of the energy recovery wheel 122 in a second direction 150 that is generally opposite the first direction 142. The exhaust blower of the HVAC system 104 may force the return air 148 through an exhaust air outlet 152 of the enclosure 102 as exhaust air 154.

As noted above, in embodiments where a relatively large temperature differential exits between the outdoor air 138 and the return air 148, the energy recovery wheel 122 may be operable to recover thermal energy from the return air 148 before the return air 148 discharges from the HVAC system 104. Particularly, the energy recovery wheel 122 may include a plurality of heat transfer elements 160 that facilitate the transfer of thermal energy from the outdoor air 138 to the return air 148, or vice versa. The heat transfer elements 160 may be formed from a permeable matrix material, a porous material, a desiccant material, and/or any other suitable heat and/or moisture absorbing material. For example, in embodiments where the HVAC system 104 is operating in a cooling mode, a temperature of outdoor air 138 entering the enclosure 102 may be relatively high, while a temperature of the previously-conditioned return air 148 is relatively low. Accordingly, relatively cool return air 148 flowing across heat transfer elements 160 of the second portion 130 of the energy recovery wheel 122 may absorb thermal energy from these heat transfer elements 160 and, thus, reduce a temperature of the heat transfer elements 160. Upon traversing the second portion 130 of the energy recovery wheel 122, the return air 148, which has increased in temperature, may exhaust from the HVAC system 104 via the exhaust air outlet 152 as the exhaust air 154.

As the energy recovery wheel 122 rotates about the central axis 132, the cooled heat transfer elements 160 within the return air flow path 120 may transition into the outdoor air flow path 118. The heat transfer elements 160 entering the outdoor air flow path 118 may therefore absorb thermal energy from the warmer outdoor air 138 flowing thereacross. As such, the energy recovery wheel 122 may cool or pre-condition the outdoor air 138 by absorbing thermal energy from the outdoor air 138. That is, the energy recovery wheel 122 may pre-condition the outdoor air 138 by effectively transferring thermal energy from the outdoor air 138 to the return air 148. It should be noted that the energy recovery wheel 122 may alternatively be used to transfer energy from the return air 148 to the outdoor air 138, for example, in embodiments where the HVAC system 104 is operating in a heating mode, rather than a cooling mode.

Figure 12:
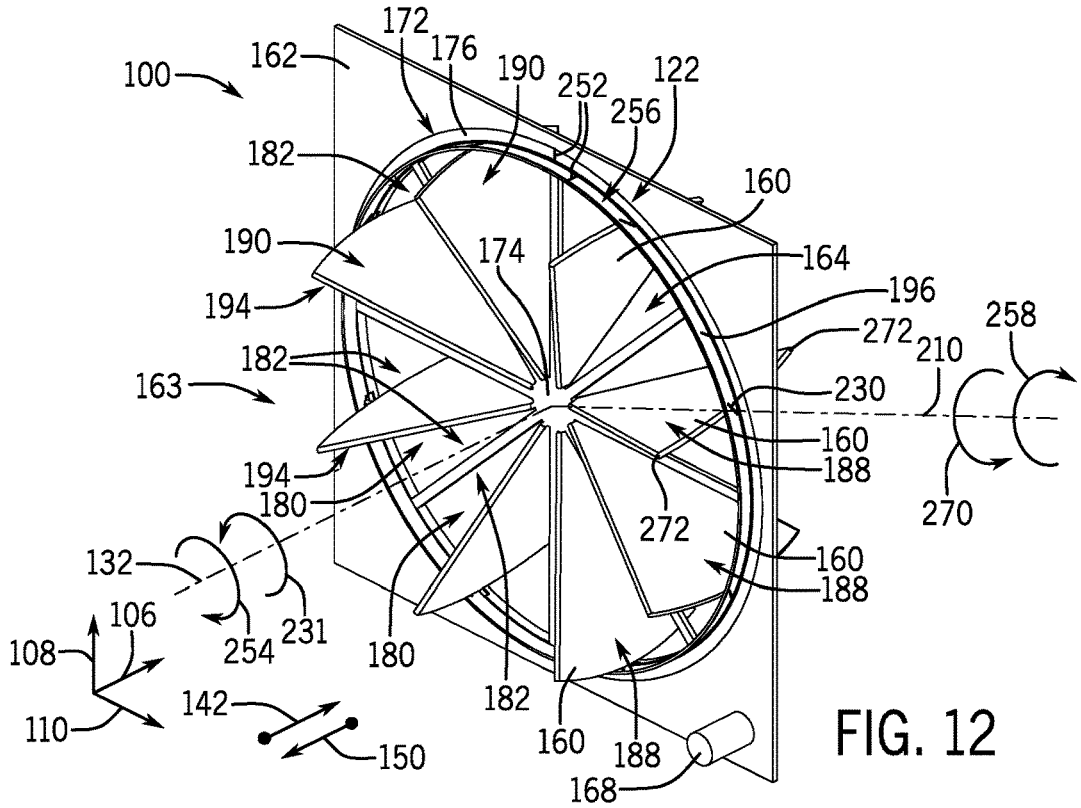
FIG. 12 is a perspective view of an embodiment of an energy recovery wheel assembly having an energy recovery wheel in an open configuration, in accordance with an aspect of the present disclosure.
Figure 13:
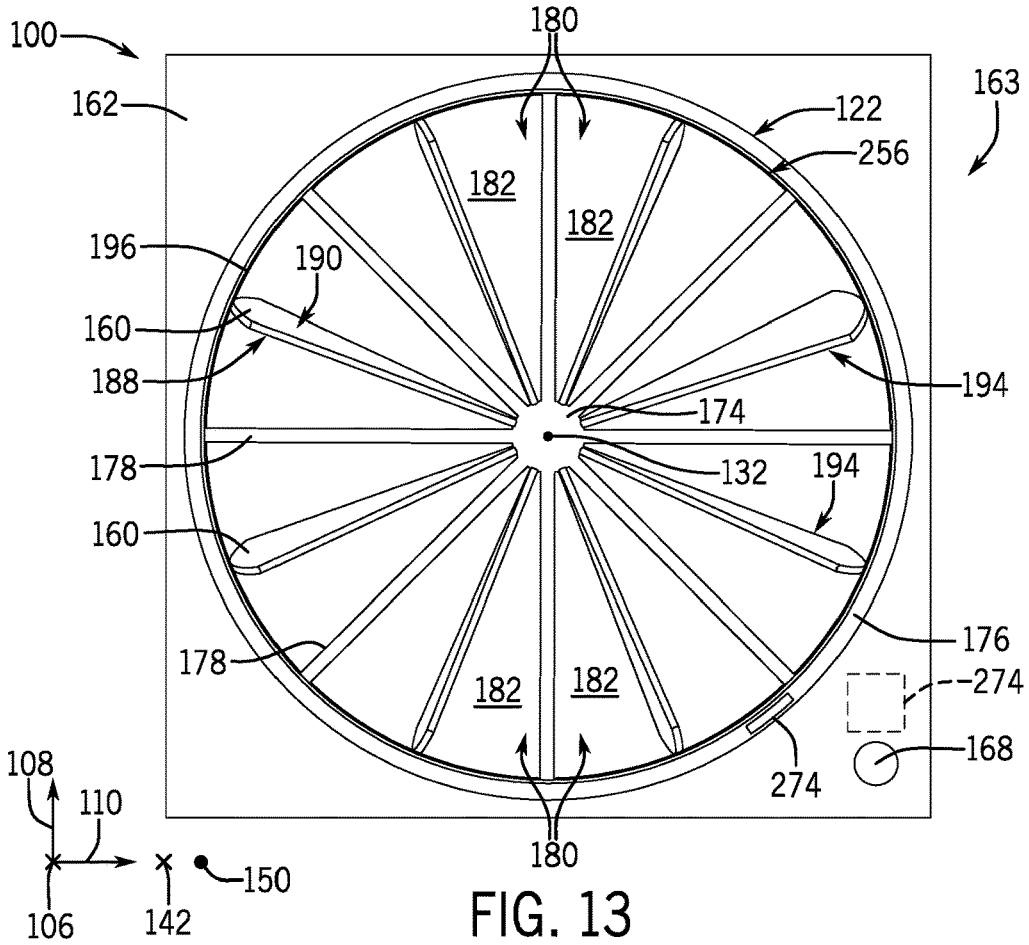
FIG. 13 is a front view of an embodiment of an energy recovery wheel assembly having an energy recovery wheel in an open configuration, in accordance with an aspect of the present disclosure.
Figure 14:
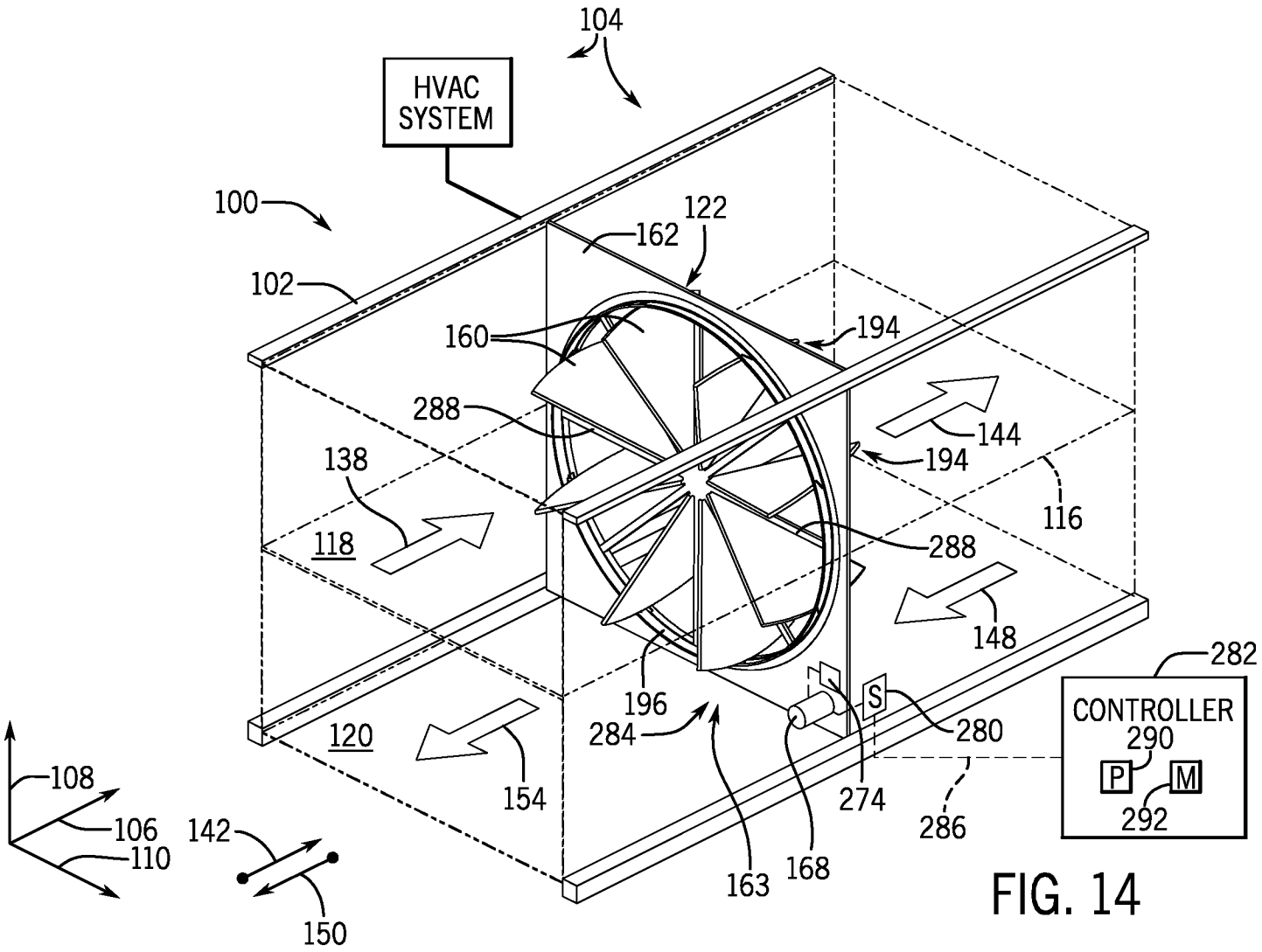
FIG. 14 is a perspective view of an embodiment of an HVAC enclosure having an energy recovery wheel in an open configuration, in accordance with an aspect of the present disclosure.

As discussed in detail below, the heat transfer elements 160 may be rotatably or pivotably mounted to the energy recovery wheel 122, thereby enabling the energy recovery wheel 122 to transition between an operational configuration 161, in which the outdoor air 138 and the return air 148 are forced across the heat transfer elements 160, and a non-operational configuration 163, as shown in FIGS. 12-14, in which the outdoor air 138 and the return air 148 may bypass the heat transfer elements 160. Accordingly, in the non-operational configuration 163, the energy recovery wheel 122 may enable substantially unrestricted air flow along the outdoor air flow path 118 and the return air flow path 120, such that a pressure drop across the energy recovery wheel 122 may be reduced or substantially eliminated.

Figure 6:
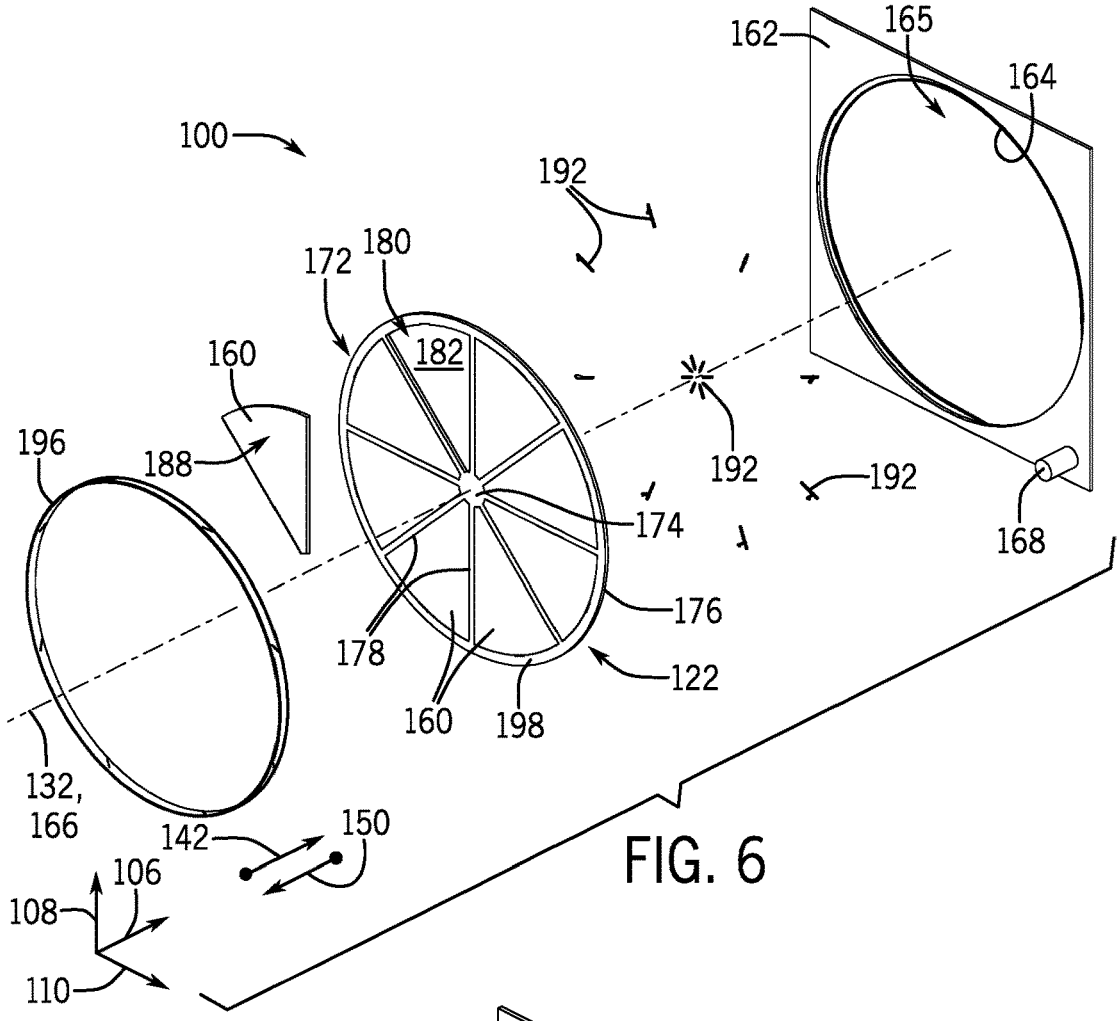
FIG. 6 is an exploded perspective view of an embodiment of an energy recovery wheel assembly, in accordance with an aspect of the present disclosure.
Figure 7:
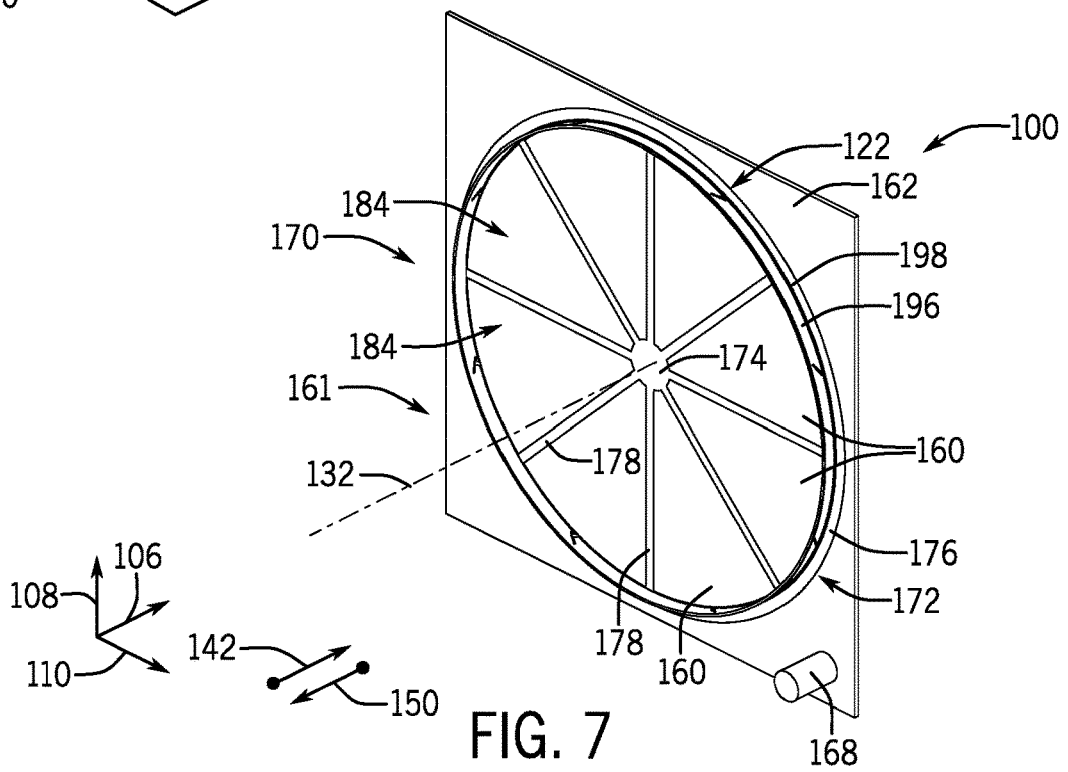
FIG. 7 is a perspective view of an embodiment of an energy recovery wheel assembly having an energy recovery wheel in a closed configuration, in accordance with an aspect of the present disclosure.

FIG. 6 is an exploded perspective view of an embodiment of the ERW assembly 100. As shown in the illustrated embodiment, the ERW assembly 100 includes an outer frame, referred to herein as a shroud 162, which includes a passage 164 formed therein. The passage 164 defines an air flow path 165 through the shroud 162 and may be configured to receive the energy recovery wheel 122. Particularly, the energy recovery wheel 122 may be positioned within the passage 164 such that the central axis 132 of the energy recovery wheel 122 aligns with a centerline 166 of the passage 164. The energy recovery wheel 122 may be rotatably coupled to the shroud 162 and may be configured to rotate relative to the shroud 162 about the central axis 132 and the centerline 166. For example, an actuator 168, such as an electric motor, a pneumatic motor, a hydraulic motor, or other suitable actuator, may be used to drive rotation of the energy recovery wheel 122 within the shroud 162. The actuator 168 may be coupled to the energy recovery wheel 122 via an arrangement of gears, a belt or rope drive system, or any other suitable power transmission system. An outer diameter of the energy recovery wheel 122 may be substantially equal to an inner diameter of the passage 164. Accordingly, in an assembled configuration 170, as shown in FIG. 7, of the ERW assembly 100, air flow between the shroud 162 and the energy recovery wheel 122 may be substantially blocked.

As shown in the illustrated embodiment, the energy recovery wheel 122 includes a frame 172 that is configured to receive and support the heat transfer elements 160. The frame 172 includes a central hub 174 that is positioned concentrically within an outer ring 176 of the frame 172. A plurality of dividers, also referred to herein as a plurality of spokes 178, may extend radially from the central hub 174 and may couple to the outer ring 176. Accordingly, the central hub 174, the outer ring 176, and the spokes 178 may cooperate to form a plurality of receptacles 180 that each define an air flow path or an opening 182 through the energy recovery wheel 122. Each of the receptacles 180 may be configured to receive one of the heat transfer elements 160 of the energy recovery wheel 122. A geometric shape of the heat transfer elements 160 may be substantially similar to a geometric shape of the receptacles 180. Accordingly, airflow between the frame 172 and the heat transfer elements 160 may be substantially blocked when the heat transfer elements 160 are positioned in closed configurations 184, as shown in FIG. 7, within the receptacles 180, such as when the energy recovery wheel 122 is in the operational configuration 161.

For clarity, in the closed configurations 184 of the heat transfer elements 160, respective first permeable end surfaces 188 and respective second permeable end surfaces 190 (e.g., as shown in FIG. 12) of each of the heat transfer elements 160 may be oriented substantially perpendicular to a direction of air flow through the openings 182. Therefore, in the operational configuration 161 of the energy recovery wheel 122, substantially all air flowing along the outdoor air flow path 118 and the return air flow path 120 may be directed across the heat transfer elements 160. In other words, when the heat transfer elements 160 are in their respective closed configurations 184, the outdoor air 138, the return air 148, or both, may flow across or through the heat transfer elements 160 from the first permeable end surfaces 188 to the second permeable end surfaces 190, or vice versa.

As shown in the illustrated embodiment, the heat transfer elements 160 and the receptacles 180 may each include a generally pie-shaped perimeter. However, it should be noted that, in other embodiments, the heat transfer elements 160 and the receptacles 180 may include any other suitable perimeter or geometric cross-section. Moreover, although the energy recovery wheel 122 includes eight heat transfer elements 160 in the illustrated embodiment, in other embodiments, the energy recovery wheel 122 may include any other suitable quantity of heat transfer elements 160. For example, in some embodiments, the energy recovery wheel may include 1, 2, 3, 4, 6, 8, 12, or more than 12 heat transfer elements 160.

As discussed in detail below, the heat transfer elements 160 may be rotatably coupled to the frame 172 via a plurality of pins 192. Indeed, the pins 192 may be configured to block translational movement of the heat transfer elements 160 relative to the frame 172, while enabling the heat transfer elements 160 to rotate or pivot relative to the frame 172 between the closed configurations 184 and respective open configurations 194, as shown in FIGS. 12-14. The ERW assembly 100 includes a guide ring 196 that is configured to engage with the pins 192 and drive rotation of the pins 192. The guide ring 196 may be rotatably coupled to the frame 172, the shroud 162, or both, such that the guide ring 196 may rotate independently of the frame 172 and the shroud 162. As discussed below, rotational motion of the guide ring 196 relative to the frame 172 may enable the guide ring 196 to impart rotational motion to the pins 192. In this manner, the guide ring 196 may enable the pins 192 to rotate the heat transfer elements 160 between the closed and open configurations 184, 194. In some embodiments, the guide ring 196 may be concentrically aligned with the frame 172 and may be configured to abut an end face 198 of the frame 172.

Figure 8:
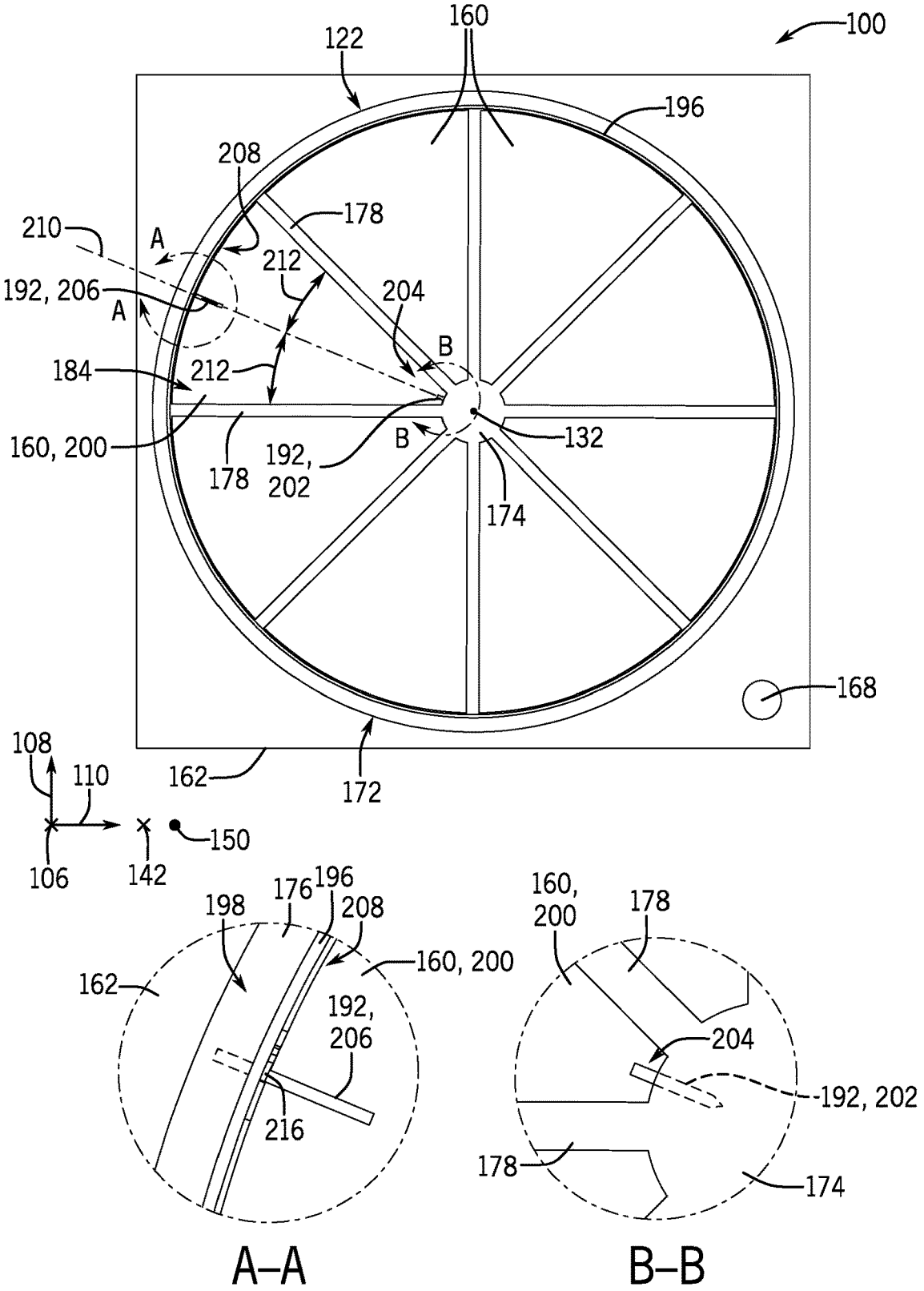
FIG. 8 is a front view of an embodiment of an energy recovery wheel assembly, in accordance with an aspect of the present disclosure.

FIG. 8 is a front view of an embodiment of the ERW assembly 100. As noted above, each of the heat transfer elements 160 may engage with and pivotably couple to the frame 172 via the pins 192. For conciseness, the engagement between a first heat transfer element 200 of the heat transfer elements 160 and the frame 172 will be discussed below. However, it should be noted that pins 192 may rotatably or pivotably couple the remaining heat transfer elements 160 to the frame 172 in a substantially similarly manner as the first heat transfer element 200. With the forgoing in mind, the pins 192 corresponding to the first heat transfer element 200 may include an inner pin 202 and an outer pin 206. The inner pin 202 may be rigidly coupled to a first end portion 204 or radially inner portion of the first heat transfer element 200 and may be rotatably coupled to the central hub 174. The outer pin 206 may be rigidly coupled to a second end portion 208 or radially outer portion of the first heat transfer element 200 and may be rotatably coupled to the outer ring 176. The pins 192 may extend along an axis 210 that extends radially from the central hub 174 relative to the central axis 132. That is, the axis 210 may extend generally orthogonal to or radially outward from the central axis 132 of the energy recovery wheel 122. Accordingly, the pins 192 may enable the first heat transfer element 200 to rotate about the axis 210 relative to the frame 172 between the closed configuration 184 and the open configuration 194.

It should be noted that, in some embodiments, the inner pin 202 may be rotatably coupled to the first heat transfer element 200 and may be rigidly coupled to the central hub 174. In other embodiments, the inner pin 202 may be rotatably coupled to both the first heat transfer element 200 and the central hub 174. In some embodiments, the axis 210 may symmetrically bisect the first heat transfer element 200. That is, in such embodiments, arc portions 212 of the first heat transfer element 200 that extend from either side of the axis 210, at a common point along the axis 210, to the spokes 178 adjacent the first heat transfer element 200 may be substantially equal. However, in other embodiments, the axis 210 may extend though the first heat transfer element 200 in any other suitable manner, such that the arc portions 212 at a common point along the axis 210 may be unequal to one another. Moreover, it should be noted that, in certain embodiments of the ERW assembly 100, a single pin 192 may be used to rotatably couple the first heat transfer element 200 to the frame 172 instead of the inner and outer pins 202, 206. For example, the first heat transfer element 200 may be rotatably coupled to the frame 172 via a single pin 192 that extends through the first heat transfer element 200 from the central hub 174 to the outer ring 176.

In some embodiments, the outer pin 206 may include a drive arm 216 that extends from the outer pin 206 along the second direction 150 and engages with the guide ring 196. That is, the drive arm 216 may extend past the end face 198 of the frame 172 in the second direction 150, thereby enabling the drive arm 216 to engage with the guide ring 196. As discussed in detail below, the engagement between the drive arm 216 and the guide ring 196 enables the guide ring 196 to rotate the outer pin 206 about the axis 210 when the guide ring 196 rotates about the central axis 132. In this manner, the guide ring 196 enables the outer pin 206 to transition the first heat transfer element 200 between the closed configuration 184 and the open configuration 194.

Figure 9:
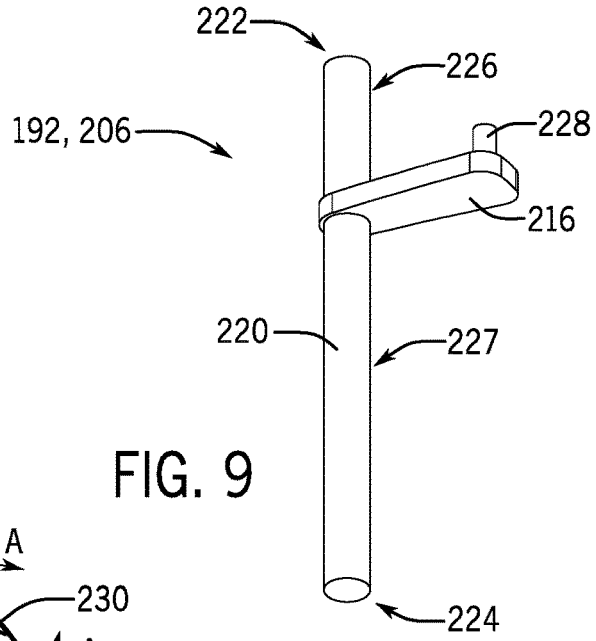
FIG. 9 is a perspective view of an embodiment of a pin of an energy recovery wheel, in accordance with an aspect of the present disclosure.

FIG. 9 is a perspective view of an embodiment of the outer pin 206. As shown in the illustrated embodiment, the outer pin 206 includes a shaft 220 that extends from a first end portion 222 of the outer pin 206 to a second end portion 224 of the outer pin 206. That shaft 220 includes a first section 226 that is configured to rotatably couple to the outer ring 176 of the frame 172 and a second section 227 that may be configured to rigidly couple to the first heat transfer element 200 or a frame of the first heat transfer element 200. The drive arm 216 may extend generally cross-wise from the shaft 220 and may include a tracing peg 228 that extends from the drive arm 216 toward the first end portion 222 of the outer pin 206. In some embodiments, the tracing peg 228 may include a generally circular cross-section and may extend generally parallel to the shaft 220. The tracing peg 228 may be configured to engage with a slot 230, as shown in FIG. 10, of the guide ring 196, such that rotational motion of the guide ring 196 about the central axis 132 may cause the tracing peg 228 to translate along the slot 230.

Figure 10:
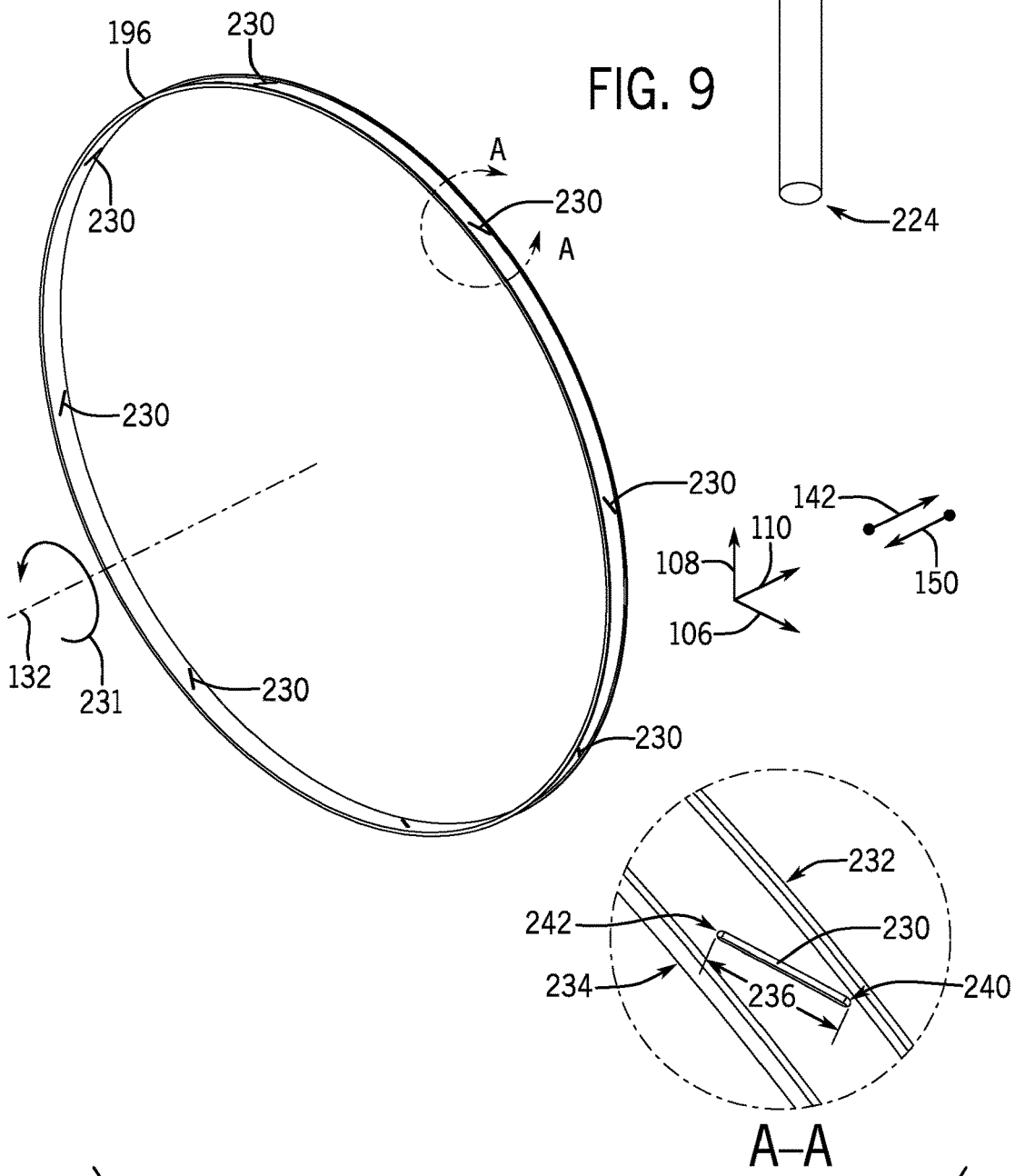
FIG. 10 is a perspective view of an embodiment of a guide ring of an energy recovery wheel, in accordance with an aspect of the present disclosure.

To better illustrate, FIG. 10 is a perspective view of an embodiment of the guide ring 196. For clarity, it should be noted that guide ring 196 may include a plurality of slots 230 that are each configured to engage with a respective outer pin 206 of the heat transfer elements 160. However, for conciseness, the slot 230 corresponding to the outer pin 206 of the first heat transfer element 200 will be discussed below. As shown in the illustrated embodiment, the slot 230 may extend along the guide ring 196 in a counter-clockwise direction 231 from a first axial end portion 232, which may abut the end face 198 of the frame 172 of the guide ring 196, toward a second axial end portion 234 of the guide ring 196. Although the slot 230 is shown as extending substantially linearly along a length 236 of the slot 230, it should be noted that, in other embodiments, the slot 230 may include any other suitable slope or profile. For example, in some embodiments, the slot 230 may include a curved profile that extends from an initiating end 240 of the slot 230 to a terminal end 242 of the slot 230. In any case, the tracing peg 228 may be configured to engage with the slot 230 and to slide along the length 236 of the slot 230 when the guide ring 196 rotates relative to the frame 172.

Figure 11:
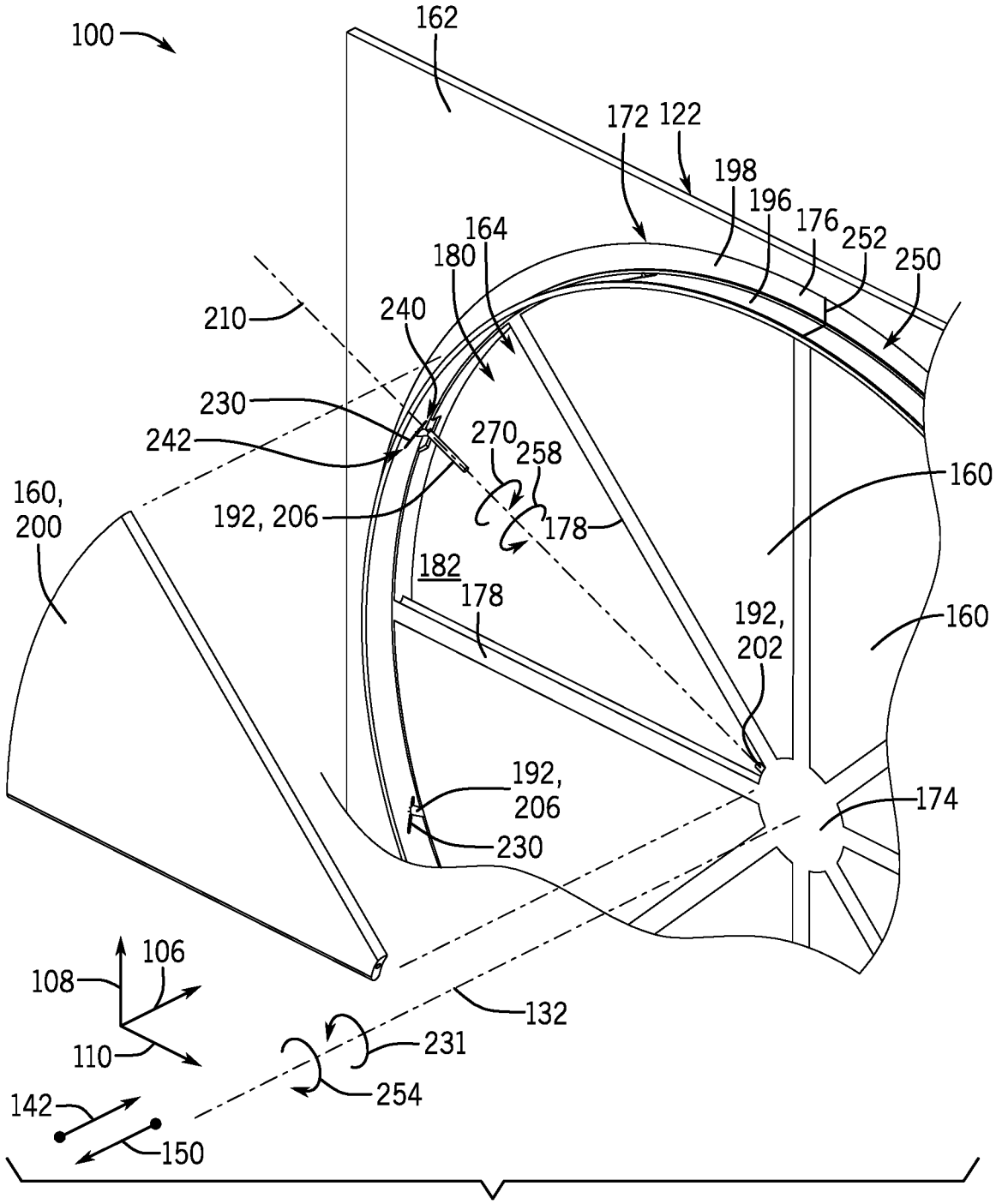
FIG. 11 is an expanded perspective view of an embodiment of an energy recovery wheel assembly, in accordance with an aspect of the present disclosure.

To better illustrate the engagement between the outer pin 206 and the guide ring 196, FIG. 11 is a perspective view of an embodiment of the ERW assembly 100. It should be noted that the first heat transfer element 200 has been removed from its respective receptacle 180 to better show the outer pin 206 and the guide ring 196. In the illustrated embodiment, the guide ring 196 is positioned in a first orientation 250 relative to the frame 172. In the first orientation 250, markers 252 on the guide ring 196 and the frame 172 may be radially aligned with one another. In the first orientation 250 of the guide ring 196, the tracing peg 228 may be positioned at or proximate to the initiating end 240 of the slot 230, such that the outer pin 206 is positioned at a first angular orientation with respect to the axis 210. Specifically, in the first angular orientation, the outer pin 206 may position the first heat transfer element 200 in the closed configuration 184, such that the first heat transfer element 200 occludes the opening 182 defined by the receptacle 180 of the first heat transfer element 200.

To transition the first heat transfer element 200 from the closed configuration 184 to the open configuration 194, the guide ring 196 may rotate about the central axis 132 in a clockwise direction 254 relative to the frame 172. In particular, the guide ring 196 may rotate to a second orientation 256, as shown in FIG. 12, where the markers 252 are radially offset from one another. As an example, the guide ring 196 may rotate approximately 15 degrees about the central axis 132 in the clockwise direction 254 to transition from the first orientation 250 to the second orientation 256. However, in other embodiments, the guide ring 196 may rotate by an angular increment that is less than or greater than 15 degrees when transitioning between the first and second orientations 250, 256. In any case, rotating the guide ring 196 from the first orientation 250 to the second orientation 256 causes the tracing peg 228 to translate along the profile of the slot 230 from the initiating end 240 to the terminal end 242 of the slot 230. As a result, the drive arm 216 translates along the slot 230 and thereby rotates the outer pin 206 in a counter-clockwise direction 258 about the axis 210 relative to the central hub 174. The rotation of the outer pin 206, which is rigidly attached to the first heat transfer element 200, drives rotation of the first heat transfer element 200 from the closed configuration 184 to the open configuration 194. That is, the outer pin 206 may rotate the first heat transfer element 200 in the counter-clockwise direction 258 about the axis 210, relative to the central hub, from the closed configuration to 184 to the open configuration 194. Accordingly, the first heat transfer element 200 may substantially unblock the opening 182 defined by the receptacle 180 of the first heat transfer element 200 and enable substantially unrestricted air flow therethrough.

To transition the first heat transfer element 200 from the open configuration 194 to the closed configuration 184, the guide ring 196 may rotate in the counter-clockwise direction 231 about the central axis 132 from the second orientation 256 to the first orientation 250. Accordingly, the guide ring 196 will rotate the outer pin 206 in the a clockwise direction 270 about the axis 210, with respect to the central hub 174, such that the outer pin 206 transitions the first heat transfer element 200 from the open configuration 194 to the closed configuration 184. That is, the outer pin 206 rotates the first heat transfer element 200 in the clockwise direction 270 about the axis 210 from the open configuration 194 to the closed configuration 184.

In accordance with the techniques discussed above, the guide ring 196 may be configured to rotate each of the heat transfer elements 160 in a same direction about their respective axes 210 from the closed configurations 184 to the open configurations 194. Similarly, the guide ring 196 may be configured to rotate each of the heat transfer elements 160 in a same direction about their respective axes 210 from the open configurations 194 to the closed configurations 184. However, it should be noted that, in some embodiments, the slots 230 of the guide ring 196 may be formed such that rotation of the guide ring 196 in a particular direction imparts rotation to a first subset of the heat transfer elements 160 in a first direction about the corresponding axes 210, while imparting rotation to a second subset of the heat transfer elements 160 in a second direction in about the corresponding axes 210, where the second direction is opposite to the first direction. As an example, in such embodiments, a first subset of the heat transfer elements 160 may be configured to transition from respective closed configurations 184 to respective open configurations 194 by rotating about the respective axes 210 in the counter-clockwise direction 258, while a second subset of the heat transfer elements 160 may be configured to transition from the respective closed configurations 184 to the respective open configurations 194 by rotating about the respective axes 210 in the clockwise direction 270. In certain embodiments, in the closed configurations 184, the heat transfer elements 160 may be disposed within the passage 164 of the shroud 162. Conversely, in the open configurations 194, respective tip portions 272, as shown in FIG. 12, of the heat transfer elements 160 may protrude axially from the passage 164 relative to the central axis 132.

As mentioned above, FIG. 12 is a perspective view of an embodiment of the energy recovery wheel 122 in the non-operational configuration 163, in which each of the heat transfer elements 160 is positioned in their respective open configuration 194. In some embodiments, the first and second permeable end surfaces 188, 190 of the heat transfer elements 160 may be oriented substantially parallel to a direction of air flow through the openings 182 when in the heat transfer elements 160 are oriented in the open configurations 194. That is, in the open configurations 194, the heat transfer elements 160 may be rotated approximately ninety degrees in the counter-clockwise direction 258 about their respective axes 210 with respect to the closed configurations 184, such that the heat transfer elements 160 substantially unblock the openings 182 defined by the receptacles 180.

For example, FIG. 13 is a front view of an embodiment of the energy recovery wheel 122 in the non-operational configuration 163. As shown in the illustrated embodiment, when the heat transfer elements 160 are positioned in the open configurations 194, the heat transfer elements 160 may substantially unblock to openings 182 to enable substantially unimpeded air flow across the energy recovery wheel 122. In this manner, the energy recovery wheel 122 may reduce fluid restrictions along the outdoor air flow path 118 and/or the return air flow path 120 during inactive operational periods of the energy recovery wheel 122. That is, in the open configurations 194 of the heat transfer elements 160, a substantially negligible amount of air may flow through the heat transfer elements 160 between the first permeable end surfaces 188 and the second permeable end surfaces 190 of the heat transfer elements 160, thereby reducing a pressure drop across the energy recovery wheel 122.

The ERW assembly 100 may include an actuator 274 that is configured to selectively rotate the guide ring 196 relative to the frame 172 between the first and second orientations 250, 256, and thus, may be used to adjust a position of the heat transfer elements 160. In some embodiments, the actuator 274 may be coupled to the frame 172 of the energy recovery wheel 122 and may be configured to rotate with the frame 172 during normal operation of the energy recovery wheel 122. In other embodiments, the actuator 274 may be coupled to the shroud 162 or to a portion of the enclosure 102 of the HVAC unit 12. As an example, the actuator 274 may include an electric motor that is coupled to the shroud 162 and is configured to drive rotation of the guide ring 196 via a set of gears or a belt system. In other embodiments, the actuator 274 may include a linear actuator or a servo motor that is operable to rotate the guide ring 196 between the first and second orientations 250, 256. In further embodiments, any other suitable actuator 274 may be used to drive rotation of the guide ring 196.

In certain embodiments, the actuator 274 may be configured to axially translate the guide ring 196 along the central axis 132 relative to the shroud 162, instead of rotating the guide ring 196 about the central axis 132 relative to the shroud 162. Translating the guide ring 196 axially along the central axis 132 may enable the guide ring 196 to transition the heat transfer elements 160 between the respective closed configurations 184 and the respective open configurations 194 in a manner similar to that discussed above. Indeed, axial translation of the guide ring 196 relative to the shroud 162 may similarly cause the tracing pegs 228 of the outer pins 206 to slide along the slots 230 of the guide ring 196 between the respective initiating ends 240 and the respective terminating ends 242 of the slots 230. Accordingly, the engagement between the tracing pegs 228 and the slots 230 may cause the guide arms 216, and thus the outer pins 206 coupled thereto, to rotate about the axes 210 in the counter-clockwise direction 258 or in the clockwise direction 270. Therefore, by axially translating the guide ring 196 along the central axis 132, the actuator 274 may transition the heat transfer elements 160 between the respective closed and open configurations 184, 194.

FIG. 14 is a perspective view of the enclosure 102 of the HVAC system 104, illustrating the energy recovery wheel 122 in the non-operational configuration 163. In some embodiments, the ERW assembly 100 may include a sensor 280 that is communicatively coupled to a controller 282 of the HVAC system 104, such as the control device 16 or the control panel 82, and is configured to provide feedback to the controller 282 indicative of an operating parameter of the ERW assembly 100, such as an orientation of the energy recovery wheel 122 with respect to the enclosure 102 or the shroud 162. In some embodiments, the controller 282 may be operatively coupled to the actuators 168, 276 and may be configured to instruct the actuator 168 to transition the energy recovery wheel 122 to a non-interfering position 284 before instructing the actuator 274 to transition the heat transfer elements 160 from the closed configurations 184 to the open configurations 194. Specifically, in the non-interfering position 284 of the energy recovery wheel 122, a pair 288 of the spokes 178 may be aligned and/or coplanar with the partition 116 of the enclosure 102. Accordingly, the controller 282 may ensure that the heat transfer elements 160 are precluded from contact with the partition 116 when transitioning from the closed configurations 184 to the open configuration 194. That is, the controller 282 may instruct the actuator 274 to transition the heat transfer elements 160 from the closed configurations 184 to the open configurations 194 upon receiving feedback from the sensor 280 indicating that actuator 168 has transitioned the energy recovery wheel 122 to the non-interfering position 284.

It should be appreciated that one or more control transfer devices, represented by dashed lines 286, such as wires, cables, wireless communication devices, and the like, may communicatively couple the actuators 168, 274, the sensor 280, or any other components of the ERW assembly 100 and/or the HVAC system 104 to the controller 282. The controller 282 may include a processor 290, such as a microprocessor, which may execute software for controlling the components of the ERW assembly 100 and/or the HVAC system 104. Moreover, the processor 290 may include multiple microprocessors, one or more "general-purpose" microprocessors, one or more special-purpose microprocessors, and/or one or more application specific integrated circuits (ASICS), or some combination thereof.

For example, the processor 290 may include one or more reduced instruction set (RISC) processors. The controller 282 may also include a memory device 292 that may store information such as control software, look up tables, configuration data, and so forth. The memory device 292 may include a volatile memory, such as random access memory (RAM), and/or a nonvolatile memory, such as read-only memory (ROM). The memory device 292 may store a variety of information and may be used for various purposes. For example, the memory device 292 may store processor-executable instructions including firmware or software for the processor 290 execute, such as instructions for controlling the components of the ERW assembly 100 and/or the HVAC system 104. In some embodiments, the memory device 292 is a tangible, non-transitory, machine-readable-medium that may store machine-readable instructions for the processor 290 to execute. The memory device 292 may include ROM, flash memory, a hard drive, or any other suitable optical, magnetic, or solid-state storage medium, or a combination thereof. The memory device 292 may store data, instructions, and any other suitable data.

As set forth above, embodiments of the present disclosure may provide one or more technical effects useful for reducing fluid restrictions along the outdoor air flow path 118 and the return air flow path 120 of an HVAC unit during inactive operational periods of the energy recovery wheel 122. In particular, the disclosed energy recovery wheel 122 is configured to transition between the operational configuration 161 and the non-operational configuration 163 to enable or substantially preclude, respectively, air flow across the heat transfer elements 160. By mitigating fluid restrictions along the outdoor air flow path 118 and the return air flow path 120 during inactive operational periods of the energy recovery wheel 122, the energy recovery wheel 122 may reduce a load on fans or blowers of the HVAC system 104 during such inactive operational periods, and thus, enhance an overall operational efficiency of the HVAC system 104. The technical effects and technical problems in the specification are examples and are not limiting. It should be noted that the embodiments described in the specification may have other technical effects and can solve other technical problems.

While only certain features and embodiments of the present disclosure have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An energy recovery wheel for a heating, ventilation, and/or air conditioning (HVAC) system, comprising:

a frame positioned within a passage of the HVAC system and configured to rotate about an axis of the passage relative to the HVAC system, wherein the frame includes an opening configured to transmit an air flow; and a heat transfer element coupled to the frame and positioned within the opening, wherein the heat transfer element is permeable and configured to transition between a closed orientation to occlude the opening and direct the air flow across the heat transfer element and an open orientation to expose the opening and mitigate interaction between the air flow and the heat transfer element.

2. The energy recovery wheel of claim 1, wherein permeable end surfaces of the heat transfer element are oriented crosswise to a direction of the air flow through the opening in the closed orientation.

3. The energy recovery wheel of claim 1, wherein permeable end surfaces of the heat transfer element extend along a direction of the air flow through the opening in the open orientation.

4. The energy recovery wheel of claim 1, wherein the heat transfer element is configured to pivot, between the closed orientation and the open orientation, about an additional axis that extends generally orthogonal to the axis of the passage.

5. The energy recovery wheel of claim 1, comprising a guide ring coupled to the frame and configured to rotate about the axis relative to the frame, wherein the guide ring is configured to engage with the heat transfer element via a pin, and wherein rotational motion of the guide ring relative to the frame is configured to transition the heat transfer element between the closed orientation and the open orientation.

6. The energy recovery wheel of claim 5, comprising an actuator configured to drive the rotational motion of the guide ring.

7. The energy recovery wheel of claim 6, wherein the actuator is coupled to the frame.

8. The energy recovery wheel of claim 6, wherein the passage is defined within a shroud of the HVAC system, and wherein the actuator is coupled to the shroud.

9. The energy recovery wheel of claim 1, wherein the frame includes an inner hub and an outer ring disposed concentrically about the inner hub, wherein the heat transfer element extends between the outer ring and the inner hub and is pivotably coupled to the outer ring and the inner hub via a pair of pins.

10. An energy recovery wheel for a heating, ventilation, and/or air conditioning (HVAC) system, comprising:

an inner frame disposed in an air flow path of the HVAC system and rotatable with respect to the HVAC system;

a plurality of dividers extending from the inner frame and positioned within the air flow path; and a plurality of matrix segments configured to transfer heat and moisture between air flows, wherein each matrix segment of the plurality of matrix segments is mounted between a pair of dividers of the plurality of dividers, such that each matrix segment is configured to pivot relative to the inner frame.

11. The energy recovery wheel of claim 10, wherein each matrix segment of the plurality of matrix segments is configured to occlude the air flow path in a respective closed position of the respective matrix segment and unblock the air flow path in a respective open position of the respective matrix segment.

12. The energy recovery wheel of claim 10, comprising a central hub, wherein the inner frame includes an outer rim disposed about the central hub, and wherein the plurality of dividers are a plurality of spokes extending from the outer rim to the central hub.

13. The energy recovery wheel of claim 12, wherein the central hub, the outer rim, and the plurality of spokes cooperatively define a plurality of receptacles, wherein each matrix segment of the plurality of matrix segments is configured to pivotably engage with a respective receptacle of the plurality of receptacles.

14. The energy recovery wheel of claim 13, wherein each matrix segment of the plurality of matrix segments is pivotably mounted within the respective receptacle of the plurality of receptacles via a pin extending between the respective matrix segment and the central hub.

15. The energy recovery wheel of claim 10, comprising an actuator configured to drive rotation of the inner frame within the air flow path of the HVAC system.

16. The energy recovery wheel of claim 10, wherein each matrix segment of the plurality of matrix segments has a pie-shaped perimeter.

17. An energy recovery wheel for a heating, ventilation, and/or air conditioning (HVAC) system, comprising:

a frame disposed within a passage of the HVAC system and rotatable about an axis of the passage relative to the HVAC system, wherein the frame includes a central hub, an outer ring disposed about the central hub, and a plurality of spokes extending between the central hub and the outer ring to form an opening therebetween; and a matrix segment pivotably coupled to the frame and mounted within the opening, wherein the matrix segment is permeable and configured rotate relative to the frame between a closed configuration to occlude the opening and an open orientation to expose the opening.

18. The energy recovery wheel of claim 17, wherein the matrix segment is pivotably coupled to the frame via a plurality of pins.

19. The energy recovery wheel of claim 18, wherein the plurality of pins includes an outer pin configured to pivotably couple the matrix segment to the outer ring and an inner pin configured to pivotably couple the matrix segment to the central hub, such that the matrix segment is configured to rotate relative to the frame about an additional axis extending through the outer pin and the inner pin.

20. The energy recovery wheel of claim 19, wherein the energy recovery wheel includes a guide ring rotatably coupled to the frame and configured to rotate about the axis relative to the frame, wherein the guide ring includes a slot formed therein, and wherein the slot is configured to engage with a tracing peg of the outer pin, such that rotation of the guide ring about the axis drives rotation of the matrix segment about the additional axis via sliding engagement between the tracing peg and the slot.

21. The energy recovery wheel of claim 19, wherein the additional axis extends generally orthogonal to the axis of the passage.

22. The energy recovery wheel of claim 17, wherein the matrix segment is positioned within the passage in the closed configuration, and wherein the matrix segment protrudes axially from the passage in the open configuration relative to the axis of the passage.

23. The energy recovery wheel of claim 17, wherein the matrix segment extends radially from the central hub to the outer ring relative to the axis of the passage.

24. The energy recovery wheel of claim 17, wherein the energy recovery wheel includes a first actuator configured to drive rotation of the frame about the axis and includes a second actuator configured to drive rotation of the matrix segment relative to the frame about an additional axis that extends generally orthogonal to the axis of the passage.

25. The energy recovery wheel of claim 24, wherein the passage is defined within a shroud of the HVAC system, wherein the first actuator is coupled to the shroud, and the second actuator is coupled to the shroud or to the frame.

* * * * *